US011400322B2

(12) United States Patent
Brose et al.

(10) Patent No.: US 11,400,322 B2
(45) Date of Patent: Aug. 2, 2022

(54) TEMPERATURE-CONTROL DEVICE FOR HEATING AND/OR COOLING GASES OR GAS MIXTURES PREFERABLY FOR THE USE IN THE FIELD OF RESPIRATORY PROTECTION

(71) Applicant: SATA GmbH & Co. KG, Kornwestheim (DE)

(72) Inventors: Jens Brose, Ottmarsheim (DE); Marco Schönemann, Wendlingen (DE)

(73) Assignee: SATA GmbH & Co. KG, Kornwestheim (DE)

( * ) Notice: Subject to any disclaimer, the term of this patent is extended or adjusted under 35 U.S.C. 154(b) by 718 days.

(21) Appl. No.: 16/278,412

(22) Filed: Feb. 18, 2019

(65) Prior Publication Data

US 2019/0175959 A1 Jun. 13, 2019

Related U.S. Application Data

(63) Continuation of application No. PCT/EP2017/000998, filed on Aug. 21, 2017.

(30) Foreign Application Priority Data

Aug. 19, 2016 (DE) ..... 202016005027.4

(51) Int. Cl.
*A62B 9/00* (2006.01)
*F25B 9/04* (2006.01)
(Continued)

(52) U.S. Cl.
CPC ..... *A62B 9/003* (2013.01); *A62B 7/02* (2013.01); *A62B 9/02* (2013.01); *A62B 18/006* (2013.01);
(Continued)

(58) Field of Classification Search
CPC .... A62B 7/00; A62B 7/02; A62B 7/10; A62B 9/00; A62B 9/003; A62B 9/006;
(Continued)

(56) References Cited

U.S. PATENT DOCUMENTS 3,103,104 A * 9/1963 Shackson ..... A41D 13/0053 62/5
3,291,126 A * 12/1966 Messick ..... A62B 9/003 128/201.29
(Continued)

FOREIGN PATENT DOCUMENTS

CN 102937344 2/2013
CN 102944080 2/2013
(Continued)

OTHER PUBLICATIONS

International Search Report dated Apr. 24, 2018 for PCT/EP2017/000998 filed Aug. 21, 2017.
(Continued)

*Primary Examiner* — Colin W Stuart
(74) *Attorney, Agent, or Firm* — Paul D. Bianco; Stephen Bongini; Fleit Intellectual Property Law

(57) ABSTRACT

A temperature-control device for heating and/or cooling gases or gas mixtures. The temperature-control device includes at least one air inlet, at least one air outlet and at least one vortex tube. The vortex tube(s) each have a vortex tube inlet, a hot air outlet and a cold air outlet. The at least one air inlet is connectable with at least one vortex tube inlet of the at least one vortex tube. The at least one air outlet can be connected at least in one flow direction with at least one hot air outlet and at least one cold air outlet of the vortex tube(s). At least one control element selectively adjusts the amount of air flow between the at least one hot air outlet and
(Continued)

the at least one air outlet or between the at least one cold air outlet and the at least one air outlet.

21 Claims, 4 Drawing Sheets

(51) Int. Cl.

| | |
|---|---|
| ***A62B 18/02*** | (2006.01) |
| ***A62B 18/00*** | (2006.01) |
| ***A62B 18/04*** | (2006.01) |
| ***A62B 7/02*** | (2006.01) |
| ***A62B 9/02*** | (2006.01) |
| *A62B 18/10* | (2006.01) |

(52) U.S. Cl.
CPC ..... *A62B 18/02* (2013.01); *A62B 18/04* (2013.01); *F25B 9/04* (2013.01); *A62B 18/10* (2013.01)

(58) Field of Classification Search
CPC .. A62B 9/02; A62B 9/04; A62B 18/00; A62B 18/006; A62B 18/10; A62B 18/04; A62B 18/02
See application file for complete search history.

(56) References Cited

U.S. PATENT DOCUMENTS

| | | | | |
|---|---|---|---|---|
| 3,630,039 | A * | 12/1971 | Hayashi | F25B 9/04 62/5 |
| 4,240,261 | A | 12/1980 | Inglis | |
| 4,333,754 | A | 6/1982 | Peter | |
| 4,914,752 | A * | 4/1990 | Hinson | A41D 13/0025 2/457 |
| 5,222,489 | A * | 6/1993 | Garoutte | A62B 7/00 128/204.15 |
| 6,289,679 | B1 | 9/2001 | Tunkel | |
| 8,616,010 | B2 | 12/2013 | Bakos | |
| 2008/0053541 | A1* | 3/2008 | Meckes | B64D 10/00 137/624.27 |
| 2009/0159715 | A1 | 6/2009 | Lessig et al. | |
| 2013/0206806 | A1* | 8/2013 | Hu | A62B 18/006 224/662 |
| 2014/0123978 | A1 | 5/2014 | Bancroft | |

FOREIGN PATENT DOCUMENTS

| | | | |
|---|---|---|---|
| DE | 1187932 | B | 2/1965 |
| DE | 50430 | | 9/1965 |
| DE | 1204942 | B | 11/1965 |
| DE | 3002887 | | 1/1981 |
| DE | 3017688 | A1 | 2/1981 |
| DE | 9112504 | U1 | 1/1992 |
| DE | 202013103995 | U1 | 9/2014 |
| DE | 202013105538 | U1 | 3/2015 |
| DE | 202015005881 | U1 | 10/2015 |
| GB | 1000818 | | 8/1965 |
| KR | 10-1038439 | | 2/2010 |
| WO | 2010/045707 | A1 | 4/2010 |
| WO | 2010126984 | A2 | 11/2010 |
| WO | 2011062958 | A2 | 5/2011 |

OTHER PUBLICATIONS

English translation of International Preliminary Report on Patentability dated Feb. 19, 2019 with Written Opinion dated May 23, 2018 for PCT/EP2017/000998 filed Aug. 21, 2017.
German Search Report dated May 18, 2017, for DE 20 2016 005 027.4.
International Search Report for PCT/EP2017/00998, dated Apr. 24, 2018 (English translation).

* cited by examiner

TEMPERATURE-CONTROL DEVICE FOR HEATING AND/OR COOLING GASES OR GAS MIXTURES PREFERABLY FOR THE USE IN THE FIELD OF RESPIRATORY PROTECTION

FIELD OF THE INVENTION

The subject matter of the invention is a temperature-control device for heating and/or cooling gases or gas mixtures, in particular for the use in the field of respiratory protection. Temperature-control devices of this type are inter alia used by painters, joiners, and varnishers who, when coating surfaces, protect themselves from harmful vapors, airborne dust, and spray mist with the aid of force-ventilated respiratory protection.

BACKGROUND

Harmful vapors which are created either by the evaporation of solvents or the atomization of liquids typically arise when processing varnishes or paints. Air contaminations of this type are in particular created in atomizing painting methods. Accordingly, the presence in an atmosphere polluted in such a manner is permitted only when using suitable respiratory protective measures. The latter include inter alia also respiratory protection apparatuses which as a respiratory protection hood or helmet can cover either the entire head, or as a half mask or full mask can cover parts of the face. Said respiratory protection apparatuses can be designed as either ambient-air-dependent or ambient-air-independent force-ventilated respiratory protection. In the field of paint processing by means of atomization, force-ventilated respiratory protection masks or hoods are typically used, since the time spent in the polluted atmosphere using ambient-air-dependent respiratory protection is heavily restricted by respective regulations, or is not permitted, respectively.

In the case of force-ventilated respiratory protection masks, the air to be inhaled is typically fed by a compressed air hose, wherein the air is initially directed through a multi-stage filter. An active-carbon filter is inter alia also used to this end in order for the fed air to be sufficiently purified. The active-carbon filter is either part of the multi-stage filter system, or is worn on the belt by the wearer of the respiratory protection. Moreover, humidity can be fed to the air by way of an air humidifier, so as to facilitate the breathing of the wearer.

In the field of the painting trade, the supply of compressed air is typically performed by way of air which is suctioned from the environment, is compressed by way of a compressor, and is directed to the work site by way of compressed air lines. Subsequently a compressed air dryer in which the compressed air for drying is cooled down to a low temperature of approx. 3 to 4° C. is usually disposed downstream of the compressor. The compressed air in most instances is subsequently temperature-controlled to a constant temperature such as, for example, 20° C. When the compressed air is now directed across a comparatively long distance, the influence of the ambient temperature on the temperature of the compressed air is significantly increased. For example, an intense lowering of the temperature thus arises when the compressed air lines are installed underground over a long distance. When the compressed air lines are not shielded from the ambient temperature across a comparatively long distance, the ambient temperature also has a strong influence on the temperature of the compressed air. In this case, solar radiation, or a high external temperature, for example, leads to the compressed air being heated.

When the air fed to the respiratory protection is too hot or too cold, this can cause discomfort to the wearer of the respiratory protection and potentially lead to health problems. The temperature of the compressed air at certain geographic latitudes can thus up to significantly below 5° C., or at other latitudes heat up to significantly above 40° C. This demonstrates that a temperature-control device which is fastened to the belt of the wearer, for example, can improve the comfort of the wearer and can prevent health problems, such as for example a common cold.

Temperature-control devices in the field of respiratory protection typically operate using a vortex tube according to Ranque-Hilsch since no external energy, apart from the supply of compressed air, is required for temperature-controlling the respiratory air for said vortex tube. The air to be temperature controlled herein is directed tangentially into a portion of a tube, on account of which the gas is set in rotation and is divided into an outer hot-air flow and an inner cold-air flow. The outer hot-air flow is then directed outward at the hot air exit of the vortex tube, and the inner cold-air flow by a cold air aperture is diverted to the cold air exit and is directed outward at the latter. Depending on whether heating or cooling of the respiratory air is to be performed, the hot-air flow or the cold-air flow can be directed to the respiratory mask. Since a loud high-frequency sound is created in the separation of the hot-air flow and the cold-air flow in the vortex tube, it is advantageous for the non-utilized gas flow to be directed through a silencer before the gas flow is diverted into the ambient air, in order for any noise pollution to be avoided. Silencers of this type according to the prior art are formed by one or a plurality of chambers which are sequentially passed through and which typically at least partially surround the vortex tube. However, chambers of this type occupy a lot of space and have a relatively minor damping effect.

As is known per se, vortex tubes for specific purposes can also be connected in parallel or in series. The throughput of the temperature equalization installation can thus be decisively increased by using a plurality of vortex tubes connected in parallel. It is likewise known that the temperature differential between the temperature at the hot air exit and the temperature at the cold air exit can be increased by placing vortex tubes in sequence. To this end, the air flow from the hot air exit or cold air exit of a first vortex tube is directed into the inlet of a second vortex tube and is again separated into two part-flows. The connection in series of the two vortex tubes can be complemented by further vortex tubes. An improved separation of a hot-air flow and a cold-air flow can be achieved, for example, by a corresponding arrangement of three vortex tubes, wherein many further possibilities of combining vortex tubes for achieving a specific purpose are known from the prior art. A corresponding arrangement having three vortex tubes can be composed of a central vortex tube into which the cold air exit of a first vortex tube and the hot air exit of a second vortex tube are directed. The cold-air flow of the central vortex tube is subsequently introduced into the first vortex tube, and the hot-air flow of the central vortex tube is introduced into the third vortex tube. The cold-air flow of the first vortex tube and/or the hot-air flow of the third vortex tube can subsequently be fed to the intended purpose. The supply of the vortex tube assembly with compressed air in this example can be performed either by way of the entry of the first vortex tube or the entry of the third vortex tube.

In the case of apparatuses for temperature-controlling respiratory air, only heating the air flow by separating a cold-air flow with the aid of a vortex tube is typically performed. Under particular operating conditions, cooling of the respiratory air can however also be advantageous for the wearer of the respiratory protection. This is the case, for example, when the supply of the respiratory protection is performed by way of particularly hot air, this being inter alia the case at particularly high external temperatures. To cater for this case, respiratory air chillers with the aid of which the air flow guided to the respiratory protection can be cooled are known. Accordingly, it is typically a function of the external temperature whether the respiratory air has to be fed directly, to be heated, or to be cooled. Since the external temperatures at various geographic latitudes can heavily vary throughout the year, it is advantageous when the respiratory air can be both heated as well as cooled by a temperature-control device, since the temperature-control device does not have to be replaced but only adjusted or switched over for different environmental conditions.

Several devices for heating respiratory air which use a vortex tube for the heating are known from the prior art. A device of this type however has the disadvantage that cooling cannot be performed in the case of particularly high external temperatures. Besides, the devices occupy a lot of space, this being caused in particular by the voluminous silencer. Since a temperature-control device is to be worn by the wearer of the respiratory protection on a belt around the hips, a particularly large device here has many disadvantages.

The known prior art also comprises a device which with the aid of a vortex tube can both heat as well as cool an air flow. In the case of the previously known device this is performed in that the air flows that exit the ends of the vortex tubes are brought together again at an adjustable ratio. The problem exists herein that both ends of the vortex tube are mutually spaced so as to be relatively far apart. This problem in the case of the device mentioned has been solved in that a vortex tube that is bent by 180° is used. A return of the air at one end of the vortex tube can thus be saved, since both sides of the vortex tube that lie beside one another have only to be brought together. A device of this type is however aerodynamically disadvantageous since the separation of the cold air flow and of the hot air flow progresses at the highest possible efficiency only in a straight vortex tube. The rotating fluid flow, which leads to a separation of the two air flows, in a bent vortex tube is disturbed by turbulences which are created by the bend of the vortex tube. A device of this type is thus less effective than a device having a vortex tube that is configured so as to be straight. On account of the lower efficiency of the bent vortex tube, a larger air volume has to be used for a specific decrease or increase of the temperature of the outflowing air. This leads to more compressed air having to be generated, on account of which the level of the operating costs is increased.

SUMMARY

One aspect of the disclosure relates to an improved temperature-control device for temperature-controlling respiratory air, in particular in the field of respiratory protection for painters, joiners, and varnishers, which permits both heating as well as cooling of the fed air, and is light and compact.

Further advantageous details and design embodiments of the invention are also disclosed.

DETAILED DESCRIPTION

Figure 1:
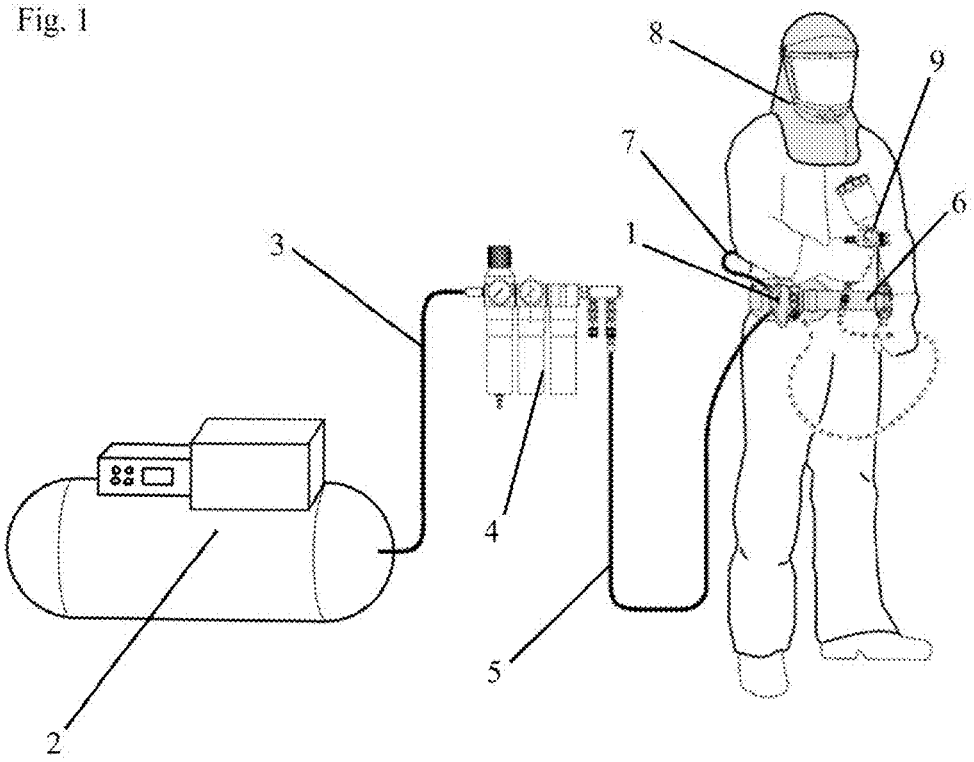
FIG. 1 shows a schematic exemplary illustration of a respiratory protection system for varnishers, having a temperature-control device and components connected thereto.

FIG. 1 shows a temperature-control device 1 in conjunction with the other elements of a respiratory protection system, in an exemplary manner for varnishers. In the case of such a respiratory protection system, the ambient air is compressed by way of a compressor 2 and is introduced in a compressed air filter 4 by way of a hose connection 3. The compressed air filter 4 is typically composed of a plurality of filter stages and should comprise an active-carbon filter so as to remove harmful organic particles and vapors, for example oil vapors, from the respiratory air. Once the compressed air exits the compressed air filter 4, said compressed air is directed by way of a hose connection 5 to the temperature-control device 1 on the belt 6 of the wearer. For sufficient temperature-controlling of the air, the entry pressure of the air flow guided into the temperature-control device herein should be above 3 bar, wherein it is a function of the entry pressure which maximum temperature differential is to be achieved between the infed and outfed air. In the case of an entry pressure of approx. 6 bar the temperature of the infed compressed air can be increased or lowered by approx. 20° C.

The temperature-control device 1 for improved ease of application is fastened to the belt 6 by means of a releasable connection. The temperature-controlled air is directed onward by the temperature-control device 1 by way of a hose connection 7 to the respiratory protection component 8, wherein the respiratory protection component here is configured as a full mask. A paint spray gun 9 can be connected in addition to the respiratory protection component. In this case, part of the air which is directed into the temperature-control device 1 can be directed onward directly to the spray gun without the temperature of the air flow being changed.

Figure 2:
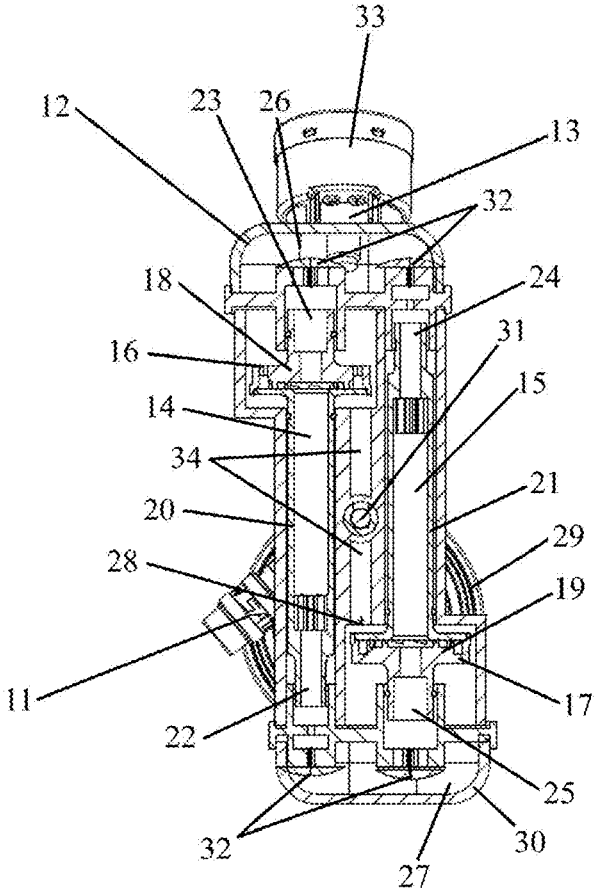
FIG. 2 shows a sectional illustration of a first embodiment of a temperature-control device according to the invention.

A sectional illustration of a first embodiment of a temperature-control device 1 according to the invention is illustrated in FIG. 2. A device for temperature-controlling respiratory air, by way of which an infed air flow can be separated into a cold and a hot air flow by means of a Ranque-Hilsch vortex tube, is proposed. To this end, an air flow is directed by way of an air inlet 11 into a housing 12, and is subsequently directed by way of a vortex tube inlet 16, 17 into two vortex tubes 14, 15, wherein the vortex tube exits 22, 23, 24, 25 are fluidically connected to an air outlet 13, by way of which the fluid exits the housing 12 and is guided to the respiratory protection component 8. Accordingly, the temperature-control device 1 is surrounded by a housing 12 in which the two vortex tubes 14, 15 are inter alia also accommodated. The vortex tubes 14, 15 is in each case composed of an elongate vortex tube body 20, 21 having in each case one vortex tube inlet 16, 17 which is situated on a plane between a hot air exit 22, 24 and a cold air exit 23, 25. Compressed air is fed to the vortex tube by way of the respective vortex tube inlet 16, 17, wherein the vortex tube inlet 16, 17 is designed in such a manner that the compressed air is introduced in the direction of the vortex tube axis from the cold air exit 23, 25 toward the hot air exit 22, 24. Furthermore provided is an air guiding element 18, 19 by way of which the introduced compressed air is diverted and introduced into the vortex tube body 20, 21. To this end, the air guiding element 18, 19 is configured in such a manner that the fluid by way of installations within the air guiding element 18, 19 is set in rotation about the vortex tube axis so as to subsequently be introduced tangentially into the cylindrical vortex tube body 20, 21. The fluid subsequently exits at the vortex tube exits 22, 23, 24, 25, wherein at least one of the cold air exits and at least one of the hot air exits of one or a plurality of vortex tubes are fluidically connected at least in a flow direction to at least one air outlet 13 by way of which the fluid exits the housing 12.

In the case of the design embodiment of the vortex tubes 14, 15 attention is to be paid to the vortex tube bodies 20, 21 not being bent, since the degree of efficiency of the vortex tube 14, 15 otherwise is reduced. On account of the principle of the Ranque-Hilsch vortex tube, the air flow which enters the housing 12 by way of the air inlet 11, depending on the selected position of the control element 31, is directed into the vortex tube body 20 or 21 by way of the vortex tube inlet 16 or the vortex tube inlet 17 and the respective air guiding element 18 or 19, the entering air flow in said vortex tube body 20 or 21 according to the principle of the Ranque-Hilsch effect being separated into a hot air flow and a cold air flow, wherein the hot air flow exits the vortex tube 14, 15 by way of the hot air exit 22, 24, and the cold air flow exits the vortex tube 14, 15 by way of the cold air exit 23, 25. Depending on whether heating or cooling of the respiratory air is to be achieved, either the hot air flow which exits the second vortex tube 15 at the hot air exit 24, or the cold air flow which exits the first vortex tube 14 at the cold air exit 23, is directed to the air outlet 13 at which the heated or cooled air flow exits the housing 12 of the temperature-control device 1 toward the respiratory protection component 8 from FIG. 1. At least one control element 31 is provided for choosing whether the hot air flow or the cold air flow is directed into the outlet chamber 26 and subsequently by way of the air outlet 13 to the respiratory protection component 8. The control element 31 accordingly serves for at least reducing either the air flow between the at least one hot air exit 22, 24 and the at least one air outlet 13, or the air flow between the at least one cold air exit 23, 25 and the at least one air outlet 13. The control element 31 in the temperature-control device 1 according to FIG. 2 is positioned between the air inlet 11 and the inlets 16, 17 of the vortex tubes 14, 15, and is designed in such a manner that the fluidic connection between the air inlet 11 and the vortex tube inlet 16 of the first vortex tube 14 is closed in a first position of the control element 31, and the fluidic connection between the air inlet 11 and the vortex tube inlet 17 of the second vortex tube 15 is closed in a second position. In the first preferred embodiment described, the control element 31 is designed in such a manner that either the first vortex tube 14 or the second vortex tube 15 is fluidically connected to the air inlet 11. Accordingly, one of the vortex tubes 14, 15 is cut off from the air inlet by the control element 31, this leading to either the first vortex tube 14 of the second vortex tube 15 being passed through. The control element can be embodied as a three-way valve, for example.

In order to guarantee that both the hot as well as the cold air flow can be directed to the air outlet 13, an outlet chamber 26 is provided within the housing 12, the hot air exit of the second vortex tube 24, the cold air exit of the first vortex tube 23, and the air outlet 13 being fluidically connected by way of said outlet chamber 26. The respiratory protection component 8 which is connected to the outlet chamber 26, depending on the position of the control element 31, can thus be supplied both with the cold air flow from the first vortex tube 14, or with the hot air flow from the second vortex tube 15. Instead of directing in each case only one of the air flows from the hot air exit of the second vortex tube 24 or from the cold air exit of the first vortex tube 23 into the outlet chamber 26, mixing of both air flows can also be performed in the outlet chamber 26. This can be achieved, for example, in that the control element 31 is designed like a three-way mixer, on account of which the ratio pertaining to which part of the fluid flow is directed to the first vortex tube 14 and which part is directed to the second vortex tube 15 can be determined. In order for a comparable effect to be achieved, the respective air flows can also be blocked or mixed at other locations of the temperature-control device 1.

In order for a change in the temperature at the air outlet 13 to be achieved, at least one of the air flows which exits from an exit of the vortex tubes 22, 23, 24, 25 has to be discharged from the housing 12. To this end, both the hot air exit of the first vortex tube 22 as well as the cold air exit of the second vortex tube 25 within the housing 12 are connected to an exhaust air chamber 27 in the first preferred embodiment. The exhaust air chamber 27 is fluidically connected to an exhaust air outlet 28 which establishes a fluidic connection between the exhaust air chamber 27 and the environment outside the housing 12. The hot air exit of the first vortex tube 22 and the cold air exit of the second vortex tube 25 are thus fluidically connected to the environment outside the temperature-control device 1 by way of the exhaust air chamber 27 and the exhaust air outlet 28.

An actuator element 29 by way of which the cross section of the exhaust air outlet 28 can be reduced or closed at at least one location is provided for controlling the quantity of air which exits the exhaust air chamber 27 to the environment through the exhaust air outlet 28. An actuator element 29 of this type can be, for example, a throttle valve. The controlling of the throttle valve can be performed, for example, by rotating a housing part. In order for this to be guaranteed, the housing can be composed of at least two parts. A housing cap 30 for controlling the throttle valve can be provided in the region of the exhaust air chamber 27, said housing cap 30 being disposed so as to be rotatable in relation to the remaining part of the housing 12 and being connected to the actuator element 29 in such a manner that a rotation of the housing cap 30 about the axis of the temperature-control device 1 causes an adjustment of the actuator element 29, and the crosssection of a fluidic connection within the housing 12 is thus at least partially reduced by the rotation of one housing part relative to another housing part. The quantity of air which is dispensed to the environment through the exhaust air outlet 28 can thus be increased or reduced by a rotation of the housing cap 30.

Since one of the vortex tubes in the first preferred embodiment is always cut off from the air inlet 11 by the control element 31, fluid passes through either only the first vortex tube 14 or only the second vortex tube 15. When one of the vortex tube ends 22, 23; 24, 25 is now at least partially blocked by way of the actuator element, the proportion of fluid which cannot directly flow out is conjointly discharged at the other end of the vortex tube. Mixing of the cold and the hot air flow within the vortex tube thus takes place. In a manner deviating from the embodiment described, a diversion of the fluid pass through the control element 31, and the discharge of the fluid through the exhaust air outlet 28, can also be performed at another location of the temperature-control device 1. A person skilled in the art, without any further input, will be aware of modifications of this type from the prior art.

Since only one of the vortex tubes 14, 15 is passed by the fluid at any one time, it has to be avoided that fluid from the outlet chamber 26, or the exhaust air chamber 27, respectively, flows into the flow-free vortex tube 14, 15. In order for this to be prevented, the vortex tubes 14, 15 at the exits 22, 23, 24, 25 thereof are provided with shut-off valves 32. According to the first preferred embodiment, the shut-off valves 32 are configured as non-return valves which open when the vortex tube 14, 15 is passed through from the inlet 16, 17 toward the outlets 22, 23, 24, 25, and said shut-off valves closing when the flow direction at the exits 22, 23, 24, 25 changes, or when the pressure in the outlet chamber 26, or the exhaust air chamber 27, respectively, is higher than the pressure in the flow-free vortex tube 13, 14. Accordingly, the first vortex tube 14 is closed by the shut-off valves 32 when fluid passes through the second vortex tube 15, and the second vortex tube 15 is closed by the shut-off valves 32 when fluid passes through the first vortex tube 14. The flow-free vortex tube 14, 15 at the hot air exit and at the cold air exit 22, 23, 24, 25 is thus closed by way of a self-closing shut-off valve 32. However, the exits of the vortex tubes 14, 15 can also be closed in another way. For example, it is likewise conceivable that only the flow-free vortex tube 14, 15 is closed at the exit 23, 24 that leads into the outlet chamber 26. Blocking the non-utilized vortex tube 14, 15 can also be performed by the control element 31. To this end, the deflection element 31 can be designed in such a manner that said deflection element 31 blocks both the non-utilized vortex tube and simultaneously also the vortex tube ends of said vortex tube. When the vortex tubes are closed by a type of non-return valve, a membrane valve which prevents the flow counter to the flow direction by the use of a membrane is expedient to this end. In principle, the valves can however also be implemented by other installations having a comparable effect.

Since it is important for several applications and operational sectors for the pressure at which the air exits the temperature-control device 1 and at which the connected respiratory protection component 8 is supplied to be known, a manometer 33 which measures and displays the pressure differential between the ambient pressure and the pressure in a region passed by the fluid within the temperature-control device 1 can be provided for the temperature-control device 1. To this end, the measurement can take place either between the cold air exit 23 of the first vortex tube 14 and the air outlet 13 or the hot air exit 24 of the second vortex tube 15 and the air outlet 13. In the case of the first preferred embodiment, the pressure measurement is provided within the outlet chamber 26. According to the pressure measurement described, the pressure difference between the ambient pressure and the pressure at which the fluid exits the cold air exit 23 of the first vortex tube 14, or the hot air exit 24 of the second vortex tube 15, respectively can be measured by the manometer 33. The measurement of the pressure can be carried out both mechanically as well as electronically, wherein the display of the pressure is performed either in analog or digital form by a display installation. To this end, the display device provided is connected to the measuring device so as to transmit the measured values to the display device. A pressure measurement can also be performed at other locations of the temperature-control device 1. For example, the manometer 33 can also sit between the air outlet 13 and the hose connection 7 to the respiratory protection component 8, or else directly in the hose connection 7. For the measurement of other pressure differentials the manometer 33 can however also be attached to another location of the temperature-control device 1.

Figure 4:
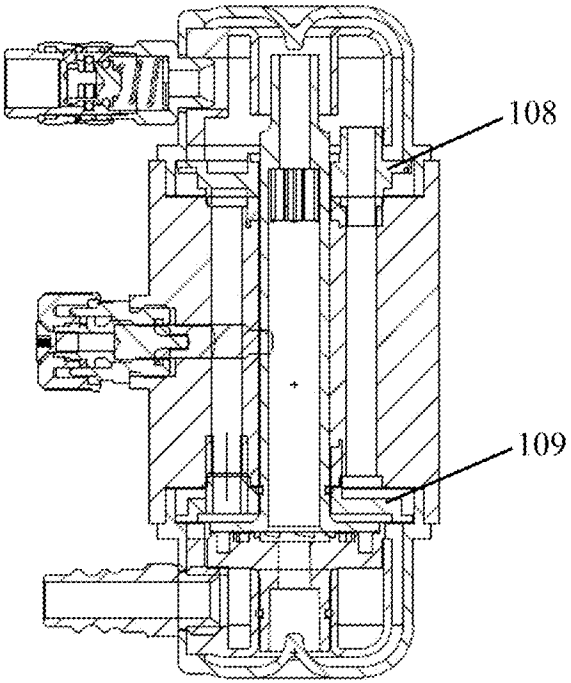
FIG. 4 shows a sectional illustration of the temperature-control device from FIG. 3 for the use as a respiratory air heater.
Figure 3:
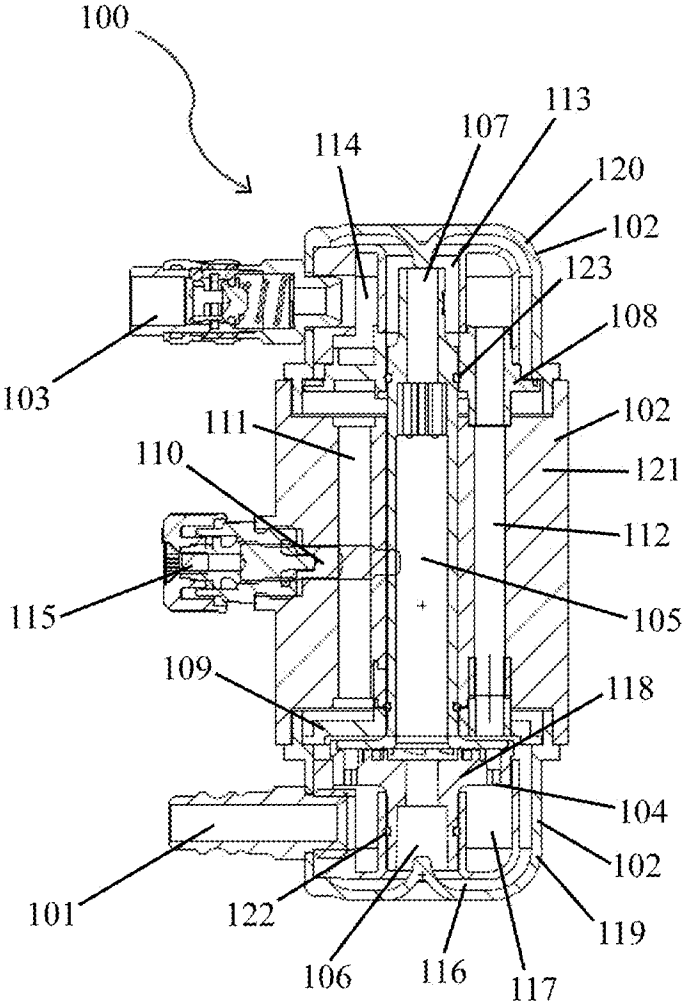
FIG. 3 shows a sectional illustration of a second embodiment of a temperature-control device according to the invention for the use as a respiratory air chiller.

FIG. 3 and FIG. 4 show a sectional illustration of a temperature-control device according to a second preferred embodiment. FIG. 3 herein shows the state as a respiratory air chiller, and FIG. 4 shows the state as a respiratory air heater. Apart from the first preferred embodiment previously described, having two vortex tubes which are disposed in dissimilar directions in the housing and are in each case used either for heating or cooling respiratory air, a temperature-control device according to the invention can also be implemented so as to have only one vortex tube. In this case, both the air flow from the hot air exit of the vortex tube as well as the air flow from the cold air exit of the vortex tube are used for temperature-controlling the respiratory air. Even when only one vortex tube is required in the case of this embodiment, said vortex tube, as is the case in the first preferred embodiment, can be connected in parallel or in series with further vortex tubes so as to increase the efficiency or the air quantity.

As is the case in the first preferred embodiment having a plurality of vortex tubes disposed in an opposing manner, the second preferred embodiment having only one vortex tube 105 likewise has an air inlet 101, at least one air outlet, 103, and a vortex tube 105 or a plurality of vortex tubes, having in each case one vortex tube inlet 104, one hot air exit 107, and one cold air exit 106. The at least one air inlet 101 herein is capable of being fluidically connected to at least one vortex tube inlet 104 of the at least one vortex tube 105, and fluidically the at least one air outlet 103 at least in a flow direction is capable of being fluidically connected to at least one hot air exit 107 and at least one cold air exit 106 of the vortex tube or the vortex tubes, respectively, wherein at least one control element 108, 109 is provided by means of which the amount of air flow between the at least one hot air exit 107 and the at least one air outlet 103, or the amount of air flow between the at least one cold air exit 106 and the at least one air outlet 103 is capable of being selectively set. Moreover, at least one air inlet and at least one air outlet can be fluidically connected by way of at least one first and at least one second vortex tube wherein the vortex tubes are disposed in a common housing.

In principle, the temperature-control device 1 shown in FIG. 4 is accordingly distinguished in that the air outlet 13 is capable of being fluidically connected to either a hot air exit 107 or a cold air exit 106 of the same at least one vortex tube 105, wherein the hot air exit 107 and the cold air exit 106 are not capable of being simultaneously connected to the air outlet 13.

In order for heating or cooling of the air flow to be achieved, the air inlet 101 is fluidically connected directly or indirectly to the vortex tube inlet 104. The inflowing air is thus directed from the air inlet 101 into the vortex tube 105 where the air flow according to the principle of the Ranque-Hilsch vortex tube is divided into a hot air flow and a cold air flow. Once the infed air flow has been divided into two air flows, the cold air flow exits the vortex tube at the cold air exit 106, and the hot air flow exits at the hot air exit 107. Since both heating and cooling of the air flow is performed by way of only one vortex tube 105, both the hot air exit as well as the cold air exit 106, 107 of the vortex tube 105 are fluidically connected to the air outlet 103 of the temperature-control device 100. On account of this arrangement, either the hot air flow, the cold air flow, or a mixture of the hot and of the cold air flow, can be directed to the air outlet 103 with the aid of a valve. To this end, two control elements 108, 109 which are configured in such a manner that either the fluidic connection between the hot air exit 107 of the vortex tube 105 and the air outlet 103, or the fluidic connection between the cold air exit 106 of the vortex tube 105 and the air outlet 103 in the cross section can at least be reduced are provided in the preferred embodiment. In the second embodiment, the control elements are designed in such a manner that the connection between the vortex tube exits 106, 107 and the air outlet 103 are either opened or closed. Accordingly, either the hot or the cold air flow is directed to the air outlet 103. In a manner deviating from the second embodiment described, a single element which can selectively block the hot air flow or the cold air flow and which directs the non-blocked air flow to the air outlet 103 can also be provided to this end.

In the second preferred embodiment described, the control elements 108, 109 are disposed so as to be coaxial about the vortex tube 105, as can be derived from FIG. 3 and FIG. 4. The control elements 108, 109 can however likewise also be disposed at another location of the temperature equalization device 100 or at another position in relation to the vortex tube 105. As has already been mentioned, mixing of the cold and the hot air flow can also be performed in a further embodiment. In this case, the hot air exit 107 and the cold air exit 106 of the vortex tube by way of a mixing installation have to be fluidically connected directly or indirectly to the air outlet 103, wherein the ratio at which the two air flows are directed to the air outlet 103 can be varied by the mixing installation. The mixing installation herein can be designed like a three-way mixer which mixes a first fluid flow with a second fluid flow at a controllable ratio.

When a temperature change at the air outlet 103 is to take place by way of the temperature-control device 100, only a part-quantity of the air flows which flow out of the exits of the vortex tube 106, 107 can be used at all times. When both air flows to the extent of 100% are directed to the air outlet 103, the exit temperature, on account of the reduction in pressure which takes place within the temperature-control device, differs only marginally from the entry temperature at the air inlet 101. Since the control elements 108, 109 close one of the fluidic connections between the exits of the vortex tubes 106, 107 and the air outlet 103, this blocked air flow has to be discharged from the housing 102. In order for said air flows to be directed out of the housing 102, not only the connections between the vortex tube exits 106, 107 and the air outlet 103 are separated by the control elements 108, 109, but connections to the exhaust air exit 110 are also established. To this end, the control elements 108, 109, in parallel with closing a fluidic connection between a vortex tube exit 106, 107 and the air outlet 103, open a connection between the vortex tube exit 106, 107, the latter having been separated from the air outlet 103, and an exhaust air outlet 110 by way of which the air flow to be discharged exits the housing 102 of the temperature-control device 100 to the environment. In the second preferred embodiment, described according to FIG. 3 and FIG. 4, an exhaust air chamber 111 into which the air to be discharged is directed from one of the vortex tube exits 106, 107 of the vortex tube 105 by way of a fluidic connection in order to subsequently discharge the air flow from the housing 102 into the environment by way of the exhaust air outlet 110 that is fluidically connected to the exhaust air chamber 111 is additionally provided within the housing 102. Accordingly, the hot air exit or cold air exit 106, 107, separated from the air outlet 103, of the at least one vortex tube 105 is fluidically connected to the ambient air by way of the exhaust air outlet 110. In this embodiment, additionally to the exhaust air chamber 111, a return line chamber 112 by way of which the cold air exit 106 is fluidically connected to the air outlet 103 is provided within the housing 102.

The opening of the connections between the vortex tube exits 106, 107 and the exhaust air chamber 111, like the closing of the fluidic connections between the outlets of the vortex tube 105 and the air outlet 103, is performed by way of the control elements 108, 109. To this end, the control elements 108, 109 can assume two positions. In a first position, a first cold air control element 109 releases a fluidic connection between the cold air exit 106 of the vortex tube 105 and the return line chamber 112. The cold air control element 109 simultaneously closes the fluidic connection between the cold air exit 106 of the vortex tube 105 and the exhaust air chamber 111. For the temperature-control device 100 to operate, the hot air control element 108 must likewise be situated in a first position. The hot air control element 108 in this position establishes a fluidic connection, closed by the hot air exit 107 of the vortex tube 105, between the return line chamber 112 and the air outlet 103. A fluidic connection between the hot air exit 107 of the vortex tube 105 and the exhaust air chamber 111 is simultaneously formed by the hot air control element 108. When the control elements 108, 109 are situated in a second position a fluidic connection between the cold air exit 106 of the vortex tube 105 and the exhaust air chamber 111 is established by the cold air control element 109. The cold air control element 109 simultaneously blocks the fluidic connection between the cold air exit 106 of the vortex tube 105 and the return line chamber 112. The hot air control element 108 in the second position thereof closes the fluidic connection between the hot air exit 107 of the vortex tube 105 and the exhaust air chamber 111, and simultaneously opens a connection between the hot air exit 107 of the vortex tube 105 and the air outlet 103. Thus, either the fluidic connection between the hot air exit 107 of the at least one vortex tube 105 and the air outlet 103, or the fluidic connection between the cold air exit 106 of the at least one vortex tube 105 and the air outlet 103, is closed by the control elements. However, the control elements also establish a direct or indirect fluidic connection between the hot air exit or cold air exit 106, 107, separated from the air outlet 103, of the at least one vortex tube 105 and the exhaust air chamber 111.

Since the control elements 108, 109 in the second preferred embodiment described can only assume two positions, controlling of the temperature cannot be performed by said control elements 108, 109. Control elements 108, 109 of this type enable only switching between the operation as a respiratory air heater and the operation as an respiratory air chiller. The temperature of the air which is guided to the respiratory protection component 8 from FIG. 1 according to the second preferred embodiment is performed exclusively by way of an actuator element 115 on the exhaust air chamber 111. The cross section of the exhaust air outlet 110 which represents the connection between the exhaust air chamber 111 and the ambient air, by way of said actuator element 115, can at least be reduced, on account of which less air can flow out by way of the exhaust air outlet 110 and a positive pressure is created in the exhaust air chamber 111. The positive pressure leads to the air flow which exits the vortex tube exit 106, 107 to back up and in part to be conjointly discharged at the opposite vortex tube exit 106, 107. On account of this principle, the cold and the warm air flow mix within the vortex tube 105, this leading to an increase or a decrease in the temperature at the air outlet.

In the second preferred embodiment described so far, only two different positions of the control elements 108, 109 are provided. For improved controllability of the exit temperature or of the volumetric throughput, a plurality of stages or an infinite adjustment can also be provided for the control elements 108, 109. In this case, the control element or control elements 108, 109 is/are designed in such a manner that the fluidic connection between the cold air exit 106 of the vortex tube 105 and the air outlet 103, or between the hot air exit 107 of the vortex tube 105 and the air outlet 103, respectively, cannot only be fully opened or fully closed. Rather, the cross section of the fluidic connections between the hot air exit 107 and the air outlet 103, or between the cold air exit 106 and the air outlet 103, respectively, by way of the control elements 108, 109 can in this case be reduced in stages or in an infinite manner up to the closure of the fluid duct at at least one location. The cross section of the fluidic connection between the cold air exit 106 of the vortex tube 105 and the air outlet 103 is advantageously reduced, while the cross section of the fluidic connection between the hot air exit 107 of the vortex tube 105 and the air outlet 103 is widened. Conversely, in the case of the cross section of the fluidic connection between the cold air exit 106 of the vortex tube 105 and the air outlet 103 being widened, a reduction of the cross section of the fluidic connection between the hot air exit 107 of the vortex tube 105 and the air outlet 103 is performed. A widening or tightening of the crosssection is typically performed by the control element or control elements 108, 109 per se, wherein it is also conceivable for an element which is connected directly or indirectly to the control element or control elements 108, 109 to be used to this end. On account of one of the fluid ducts being widened and the other fluid duct simultaneously being tightened, the air volume that exits the temperature-control device 100 by way of the air outlet 103 remains at approximately the same level, to the extent that the fluidic connection between the exhaust air chamber 111 and the exhaust air outlet 110 is sufficiently opened by the actuator element 115. An actuator element 115 of this type for regulating the air quantity flowing out of the exhaust air chamber 111 into the environment is in this case not inevitably necessary for regulating the temperature. In the case of this embodiment it is disadvantageous that a fine adjustment of the temperature of the air flow which is directed to the respiratory protection component 8 from FIG. 1, in the case of temperature being regulated by way of the control elements 108, 109, as opposed to the temperature being regulated by way of an actuator element 115 between the exhaust air chamber 111 and the exhaust air outlet 110, is possible only in a relatively inaccurate manner. Since a respiratory air heater is used in the case of low external temperatures, and a respiratory air chiller is used in the case of high external temperatures, repeated switching between the function as a respiratory air heater and the function as a respiratory air chiller is typically not required within a shorter period of time, since the external temperatures to this extent do not change at short notice. Respiratory air heaters are thus used mostly in winter or in regions having low external temperatures, and respiratory air chillers are mostly used in summer or in regions having high external temperatures. A temperature adjustment which is performed solely by the control elements 108, 109, or by a combination of both regulating possibilities, is suitable when rapid switching between both potential applications is required.

According to the second preferred embodiment of the temperature-control device 100 according to the invention the hot air control element 108 in the first position in which said hot air control element 108 separates the hot air exit 107 from the air outlet 103, forms a first hot air chamber 113 and a second outlet chamber 114, wherein both chambers according to the second preferred embodiment are situated within the housing 102 and the hot air chamber 113 is separated from the outlet chamber 114. An exhaust air chamber 111 into which the fluid is introduced by way of the hot air chamber 113 is provided herein. The hot air chamber 113 is fluidically connected to the hot air exit 107 of the vortex tube 105, wherein part of the hot air chamber 113 coaxially surrounds the end of the vortex tube 105. The hot air chamber 113 is furthermore fluidically connected to the exhaust air chamber 111. The hot air flow from the hot air exit 107 of the vortex tube 105 is thus directed through the hot air chamber 113 into the exhaust air chamber 111 and from there exits the housing 102 by way of the exhaust air outlet 110. The outlet chamber 114 connects the return line chamber 112, passed through by the cold air flow, to the air outlet 103. The cold air flow, when the fluidic connection between the hot air exit 107 of the at least one vortex tube 105 and the air outlet 103 is closed by the at least one control element 108, 109, is thus directed from the cold air exit 106 of the vortex tube 105 by way of the return line chamber 112 into the outlet chamber 114 and from there by way of the air outlet 103 in the direction of the respiratory protection component 8 on FIG. 1. The outlet chamber 114 in the second preferred embodiment described is designed in such a manner that at least part of the hot air chamber 113 is coaxially surrounded by the outlet chamber 114, the latter in turn likewise being coaxially surrounded by part of the hot air chamber 113.

According to the second preferred embodiment of the temperature-control device 100 according to the invention, the air flow which exits at the cold air exit 106 of the vortex tube 105 has to be guided to the air outlet 103 when cooling of the air is to be performed, said air exiting from the air outlet 103 toward the respiratory protection component 8. To this end, the direction of the cold air flow has to be deflected by 180° and be guided to the air outlet 103 at the opposite end of the temperature-control device 1. It is obvious to a person skilled in the art herein that the vortex tube can also be installed in the housing 102 in the opposite direction. In the case of a reversed arrangement of the vortex tube 105, the position of the hot air exit 107 is swapped with the position of the cold air exit 106. Accordingly, the hot air flow, instead of the cold air flow, has to be deflected by 180° in relation to the air outlet 103. In the deflection of the air flow it goes without saying that the air can also be diverted at another angle when a comparable effect is ultimately achieved.

According to the second preferred embodiment, the diversion of the air flow is performed by way of at least one deflection element. The deflection element in the embodiment described is implemented by a deflection chamber 116 which deflects the air flow by 180° in the direction of the air outlet 103. Alternatively, the deflection can also be performed by a plurality of elements which divert the air flow by overall approx. 180° before the air flow enters the return line chamber 112. For example, a deflection by two elements which deflect the air flow in each case by approx. 90° is also conceivable. Even further possibilities which lead to a corresponding deflection of the fluid flow and accordingly can likewise be resorted to for the deflection are known from the prior art.

In order for the cold air flow to be directed to the air outlet 103, a return line chamber 112 which is fluidically connected to the deflection chamber 116 and extends so as to be parallel with the vortex tube axis up to the outlet chamber 114 to which the return line chamber 112 is likewise fluidically connected is provided. In the embodiment described, an inlet chamber 117 which is fluidically connected to the air inlet 101 is likewise provided. The inlet chamber 117 is designed in such a manner that the air flow enters the inlet chamber 117 through the air inlet 101 and is directed through the inlet chamber 117 into the air guiding element 118 through which the air flow enters the vortex tube 105. In order for a construction mode that is as compact as possible to be achieved, the inlet chamber 117 coaxially surrounds the cold air exit 106 of the vortex tube 105, and by way of one or a plurality of openings in the side of the inlet chamber 117 that faces away from the cold air exit 106 is fluidically connected to the air guiding element 118.

As is the case in the first preferred embodiment described at the outset, having at least two vortex tubes 14, 15, it can also be advantageous in terms of the operation of the temperature-control device 100 according to the second preferred embodiment having only one vortex tube, when a manometer or another installation for pressure measurement is provided by way of which the pressure of the air guided to the respiratory protection component 8 is measured. For example, a sufficient supply of the respiratory protection component 8 with air can be guaranteed on account thereof. For the pressure measurement, the air pressure should be performed at at least one location between the air inlet 101 and the respiratory protection component 8. The pressure measurement is particularly advantageously performed by the pressure measuring installation between the air inlet 101 and the air outlet 103. Since the pressure after flowing into the outlet chamber 114 remains constant up to the respiratory protection component 8, the region of the outlet chamber 114 as well as the region between the outlet chamber 114 and the hose connection 7 to the respiratory protection component 8 are particularly suitable for a respective pressure measurement, wherein an installation for pressure measurement which is connected to the respective location is provided to this end. However, since other pressures can also be relevant to the operation of the respiratory protection device 8, a pressure measurement can also be performed in other fluidic chambers or connections. A measurement of the pressure differential between a plurality of regions within or outside the housing 102 can also be advantageous for various operating parameters. The measurement of the pressure can be performed mechanically as well as electronically, and can be delivered both in analog or digital form.

As has already been described, the temperature-control device 100 is to be worn on the belt of the wearer. In order for the device to be enabled to be worn both on the left as well as on the right side of the belt, it can be provided that the direction of the air inlet 101 and the direction of the air outlet 103 can be adjusted about the axis of the temperature-control device. It is particularly advantageous for a rotation of the inlet cap 119 and of the outlet cap 120 by in each case 180° or more to be enabled. To this end, both the housing 102 as well as the temperature-control device 100 per se are composed of at least two mutually rotatable parts, wherein the vortex tube 105 is fixedly connected to a first part of the housing. At least one second housing part to which either the air inlet 101 or the air outlet 102 is fixedly connected is furthermore provided. In a manner similar to the first preferred embodiment, the rotation of one housing part relative to another housing part can also be utilized for reducing the cross section of a fluidic connection within the housing of the temperature-control device, on account of which the temperature of the exiting air can be controlled, for example. In the second preferred embodiment according to FIG. 3 and FIG. 4, the housing 102 is constructed from three parts 119, 120, 121, wherein the three parts are disposed so as to be mutually rotatable about the longitudinal axis of the temperature-control device 100. In this second preferred design embodiment the vortex tube 105 is fixedly connected to the center part 121 of the housing, wherein an inlet cap 119 with an air inlet 101, and an outlet cap 120 having an air outlet 103, are further provided, said inlet cap 119 and said outlet cap 120 in relation to the center part 121 being disposed so as to be mutually rotatable between 70° and 200°, preferably 180°. The air inlet 101 by way of which the fluid is guided into the housing 105 herein is fixedly connected to the inlet cap 119, and the air outlet 103 by way of which the fluid is guided out of the housing is fixedly connected to the outlet cap 120. Since the temperature-control device 100 is to be designed so as to be particularly compact, the vortex tube 105 that is fixedly connected to the center part 121 protrudes into the inlet cap 119 and into the outlet cap 120.

According to the second preferred embodiment, both the inlet chamber 117 as well as the deflection chamber 116 are disposed in the interior of the inlet cap 119 and are fixedly connected to the inlet cap 119. The cold air exit 106 of the vortex tube 105 that protrudes into the inlet cap 119 herein is surrounded by the inlet chamber 117, wherein the internal face of the inlet chamber 117 is directly contiguous to the shell face of the vortex tube 105 in the region of the cold air exit 106. In order to guarantee that no fluid flows between the two contiguous faces, a first sealing element 122 is provided between both faces. Since the inlet chamber 117 is fixedly connected to the inlet cap 119, the first sealing element 122 also ensures that no fluid can flow between the faces even when both faces are mutually rotated by way of a rotation of the inlet cap 119. As can be seen from FIG. 3 and FIG. 4, the deflection chamber 116 is formed by at least part of the internal side of the inlet cap 119 and at least part of the external side of the inlet chamber 119. In order to guarantee that no fluid flow takes place between the interior of the inlet chamber 117 and the deflection chamber 116, a further sealing element can be provided on this contact face. A further sealing element can also be provided between the housing of the center part 121 and the housing of the inlet cap 119, so as to prevent any fluid flow between both housing parts both in the initial state as well as in the rotated state. In order for a production of the temperature-control device 100 that is as cost-effective as possible to be achieved, the outlet cap 120 can be designed like the inlet cap 119, on account of which both caps are mutually exchangeable. This offers the advantage that no dissimilar parts have to be made for the caps 119, 120, on account of which the production costs are inter alia reduced. For example, no dissimilar injection molding tools are required for the production of both caps 119, 120 when the caps 119, 120 are to be made from plastics material. The dissimilar air routing in both caps 119, 120 is implemented exclusively by dissimilar control elements 108, 109. Accordingly, the inlet chamber 117 in the inlet cap 119 corresponds to the outlet chamber 114 in the outlet cap 120, and the deflection chamber 116 in the inlet cap 119 corresponds to the hot air chamber 113 in the outlet cap 120. The respective chambers 113, 114, 116, 117 in the embodiment described are moreover fixedly connected to the cap 119, 120 in which the former are accommodated. In a manner comparable to that of the inlet cap 119, the hot air exit 107 of the vortex tube 105 that protrudes into the outlet cap 120 is surrounded by the outlet chamber 114, wherein the internal face of the outlet chamber 114 is directly contiguous to the shell face of the vortex tube 105 in the region of the hot air exit 107. As is the case in the inlet cap 119, a second sealing element 123 can be provided for the sealing between the hot air exit 107 and the internal face of the outlet chamber 114. Further sealing elements which, for example, seal the connection between the two housing parts 120, 121 or the connection between the hot air chamber 113 and the outlet chamber 114 can also be provided. The hot air chamber 113, like the deflection chamber 116 in the inlet cap 119, is formed by the internal side of the housing of the outlet cap 120 and the external side of the outlet chamber 114. According to the embodiment described, both the return line chamber 112 as well as the exhaust air chamber 111 are accommodated in the center part 121, wherein the chambers 111, 112 extend through the center part 121 so as to be parallel with the vortex tube axis. Both the silencer as well as the actuator element 115 in the second embodiment described are likewise parts of the center part 121. On account of the design embodiment described, both the inlet cap 119 as well as the outlet cap 120 are disposed so as to be rotatable in relation to the center part 121, wherein the individual parts can be mutually rotated about the axis of the vortex tube 105.

As can be derived from FIG. 3 and FIG. 4, the second preferred embodiment has specific features which can also be derived from the first preferred embodiment from FIG. 2. Additionally, both embodiments can be complemented by additional features which cannot be derived from FIG. 2, FIG. 3, and FIG. 4. A few additional features by way of which both the first preferred embodiment as per FIG. 2 as well as the second preferred embodiment as per FIG. 3 and FIG. 4 can be enhanced will now be described hereunder.

It can be derived from FIG. 2 as well as FIGS. 3 and 4 that the temperature-control device 1 is provided with a housing 12, 102 in which all parts of the temperature-control device 1 are preferably accommodated. This is particularly advantageous for the use in polluted environments, since cleaning of the temperature-control device 1 is facilitated on account thereof. A spray mist which only in part adheres to the surface of the object to be painted is thus created when painting for example. This part of the spray mist, referred to as overspray, is distributed in the ambient air and is only in part suctioned from the painting booth. The part of the spray mist which is not suctioned settles on all surfaces in the environment. Since a uniform distribution of the spray mist is performed in the ambient air, surfaces that face away or are covered are also covered by the overspray. A temperature-control device 1, the individual parts of which not being accommodated in a housing 12, 102 and being directly in contact with the ambient air, are contaminated by the precipitation of the overspray and over time are compromised in terms of functioning. As opposed to a housing 12, 102, temperature-control devices 1 which are not at all or only in part surrounded by a housing 12, 102 would be difficult to clean. However, temperature-control devices 1 which are not surrounded by any housing 12, 102 are also conceivable for other applications. In addition to a housing 12, 102, it is also conceivable for the temperature-control device 1 to be equipped with a replaceable cover which can be replaced in the case of excessive contamination. Said replaceable covers are advantageously products which are to be produced in a relatively cost-effective manner so as to render replacement as cost-effective as possible for the user. The respective covers cannot only be used as an addition to the housing 12, 102 but also as a replacement. Accordingly, a temperature-control device 1, instead of a housing 12, 102, can also have a replaceable cover for protection against contamination.

The temperature-control device according to the preferred embodiment is to be designed so as to be particularly space-saving so as to provide the carrier with maximum freedom of movement and an ideally positive wear experience. In the present preferred embodiments this is achieved in that the vortex tube or the vortex tubes is/are aligned along the longitudinal axis of the housing. Even when the temperature-control device is designed so as to be particularly compact, a person skilled in the art will be aware that the vortex tubes can also be disposed differently so as to achieve a comparable effect.

Figure 5:
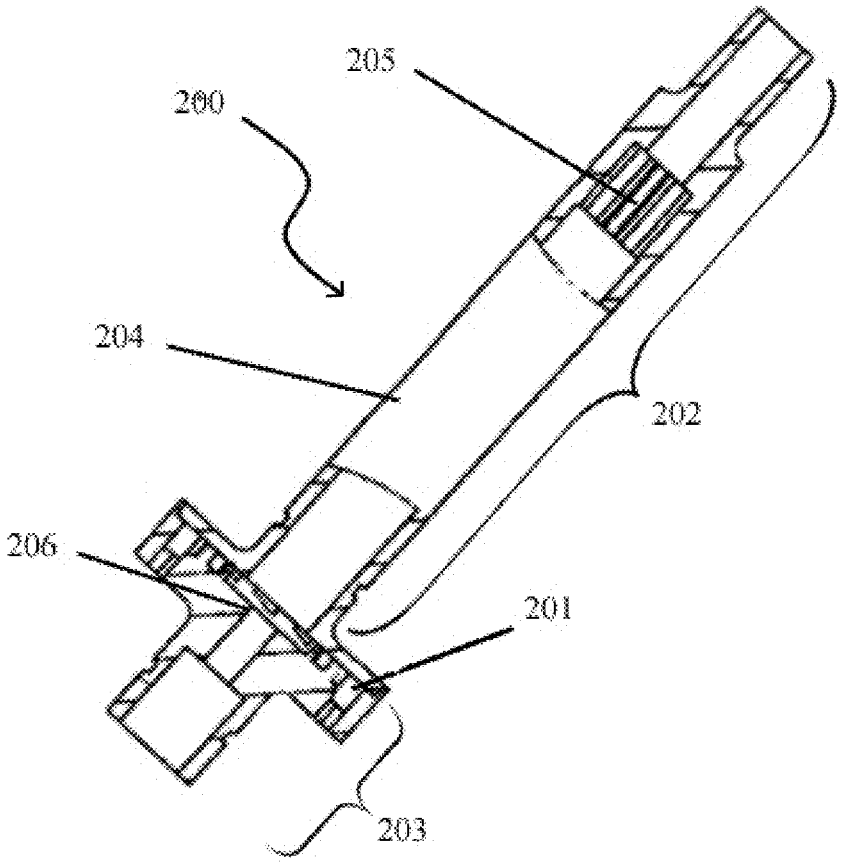
FIG. 5 shows a sectional illustration of a preferred design embodiment of a vortex tube of a temperature-control device according to FIGS. 2 to 4.

A vortex tube as can be used in the case of the above-described exemplary embodiments is depicted in FIG. 5. In order for a cost-effective production of the temperature-control device 1 to be guaranteed, it is provided that uniform vortex tubes 200 are utilized for the temperature-control of the respiratory air. This offers the advantage that only a single part has to be made for a plurality of operating conditions. Since the geometry of a respective vortex tube 200 having an air guiding element 201 cannot be made from one part, the vortex tube 200 is assembled from at least two parts 202, 203. To this end, a partition is provided in the region of the air guiding element 201 so as to facilitate the production of the vortex tube 200. The parts of the vortex tube 200 can then be connected to one another by means of a form-fit, a force-fit, or a friction-fit, for example. In this case, a plug connection with or without latching elements is particularly suitable. Since the individual parts of the vortex tube 200 can also be fixed by way of other parts, such as the housing 12, 102, for example, a fixed connection of the two vortex tube parts 202, 203 is not inevitably necessary.

In the production of a vortex tube 200 which can be used for various purposes it is to be noted that a vortex tube 200 which is to be used for cooling is ideally designed differently from a vortex tube for heating. For this reason, the uniformly produced vortex tube 200 can be adapted in a corresponding manner. To this end, a basic embodiment of the vortex tube can be complemented by further elements so as to adapt one or a plurality of parameters of the vortex tube in such a manner that improved cooling or improved heating can be achieved.

For example, the internal diameter or the length of the vortex tube body 204 can be modified by a sleeve which is plugged into the vortex tube body 204. In a similar manner, this is also conceivable for the diameter of the hot air aperture 205 or the cold air aperture 206 which can likewise be reduced by respective sleeves. Alternatively, the vortex tube 200 can also be made from three parts, wherein the air guiding element 201 herein is made as an individual part and can be replaced by an air guiding element 201 of a different design, for example having another geometry. Accordingly, the vortex tube 200 can also be composed of a kit of different parts which are assembled depending on which properties the vortex tube is to have. The production of vortex tubes 200 as kits enables a particularly cost-effective production of vortex tubes 200, wherein the individual dimensions and design embodiments of the vortex tubes 200 can be adapted almost without limitations so as to correspond to the required parameters. In order for a production of many dissimilar individual parts to be avoided, various dimensions of the basic elements of the vortex tube 200 can be modified by installation parts or add-on parts.

Since the air flow which is directed from the compressor to the respiratory protection component can contain various contaminations such as, for example, particles and oil vapors, the air upon exiting the compressor should be guided through a filter unit which is suitable for removing said contaminations. At least one centrifugal separator and one fine filter are present in most instances in the respective plants. However, an active-carbon filter is also required for removing all harmful substances. Since compressed air systems are not inevitably equipped with an active-carbon filter, an additional filter may be required. In order to avoid that an additional filter has to be fixedly installed, a respective active-carbon filter can be integrated in the temperature-control device. To this end, the air flow between the entry through the air inlet and the exit from the air outlet is directed through the active-carbon filter. To this end, the filter can be situated within or outside the housing. When the filter is situated outside the housing it is advantageous for a fastening possibility and at least one fluidic connection into the interior of the housing to be provided to this end. In this context, it is conceivable that at least one opening at which the air flow which passes through the temperature-control device, or is directed to the respiratory protection component, respectively, can be directed out of the housing into the filter unit and from the filter unit back into the housing is provided on the housing. When the filter unit is situated within the housing it is advantageous for the air flow, after the mixing of the air flows from the hot air exit and the cold air exit, to be directed into the filter. This has the advantage that only that part of the air that is also directed to the respiratory protection component passes through the filter. Accordingly, the active-carbon filter is stressed to a lesser extent than if the entire air quantity were to be passed therethrough.

In order to avoid any confusion between a plurality of temperature-control devices, a fastening by way of which a color indicator can be attached to the temperature-control device in a visible and releasable manner can is be provided. To this end, said color indicator can be attached to the external side of the outlet chamber, for example. In order for the color indicator to be attached to the housing, the housing is provided with a fastening element, for example an opening, by way of which the color indicator can be releasably fastened to the housing. Said opening can be designed in such a manner that said opening establishes a fluidic connection between the environment and a region within the housing, said region being passed through by fluid in the orderly use of the device. The described opening can be closed in a fluid-tight manner by attaching the color indicator, for example. Since a fluidic connection to the interior of the housing exists in the case of the removed color indicator, the connection into the interior of the housing can be used for introducing into the housing a measuring device, for example a manometer, for measuring a specific measured variable, wherein the opening in the case of an introduced measuring instrument is closed in a fluid-tight manner. Accordingly, a region through which fluid is passed within the housing, by way of the opening can be connected to a measuring device. It can be advantageous herein for at least part of the measuring device to be situated outside the housing, wherein said part of the measuring device can be provided with a display element by way of which the measured value is represented in analog or digital form outside the housing.

Besides a measurement of the pressure, other parameters can also be relevant to the operation of a temperature-control device or another component in the operating environment of the device. For example, an installation for temperature measurement by way of a temperature measuring installation can inter alia also be provided, by way of which installation the temperature of the fluid flow can be measured at at least one location within the temperature-control device 1, 100. In terms of the operation of the temperature-control device, the temperature of the air which is guided to the respiratory protection component is particularly relevant in this context. As is the case in the pressure measurement, it is advantageous to the temperature measurement for the measurement to take place in the outlet chamber, or between the outlet chamber and the respiratory protection component. When the temperature measurement installation is to be integrated in the temperature-control device, as is the case in pressure measurement it is expedient for the temperature to be measured in the outlet chamber, or between the outlet chamber and the connection hose to the respiratory protection component or the air outlet 13, respectively. Since temperatures in other regions of the temperature-control device can also be of significance in terms of an optimized operation of the temperature-control device, a temperature measurement can also be performed in or at another fluidic connection. Accordingly, both the pressure measurement as well as the temperature measurement can be performed at all locations of the temperature-control device which can be passed through by fluid or are contiguous to regions of this type. Apart from the measurement of the pressure or the temperature, the measurement of other parameters can also be advantageous. It is obvious to a person skilled in the art that measuring further parameters such as, for example, the air humidity, the volumetric flow, the mass flow, the temperature, the pressure, the density, or another measured variable which may be advantageous to the operation of the temperature-control device or a device in the operating environment of the temperature-control device. To this end, a measuring device which serves for measuring the respective measured variables can be provided, for example. When a temperature-control device which operates as precisely as possible is to be achieved, the measurement of some of said parameters is indispensable. The measurement of the individual parameters, like the pressure measurement, can be performed both mechanically as well as electrically, and can be indicated both by way of an analog or a digital display. To this end, a display device which is connected to the measuring device can be provided, so as to transmit the detected measured values from the measuring device to the display device in order for said detected measured values to be able to be illustrated by the display installation. The transmission of information by way of the connection between the measuring device and the display device herein can be performed mechanically, by wire, or by electromagnetic waves.

In the case of a measurement of at least one parameter such as, for example, the pressure, the temperature, the air humidity, the mass flow, the volumetric flow, or another measured variable, an active control of the temperature-control device or of the respiratory protection component or another device in the environment of the temperature-control device by means of one or a plurality of actuators is also conceivable. For example, the temperature or the mass flow to the respiratory protection component could be maintained at a constant level by way of such a control, when the respective parameters of the infed air vary. In order for a control of this type of the temperature-control device to be provided, specific entry or exit parameters of the air flowing in, flowing through, or flowing out are measured. The measured parameters are forwarded to a processing installation which, in the case of a variation of the parameters, emits a predefined signal to the actuators. The emitted signal herein is defined in such a manner that the air flow or air flows within the housing is/are influenced by the actuator elements in such a manner that the variation in the entry parameters does not have any effect on the exit parameters such as, for example, the temperature or the mass flow, or has an effect for only the shortest possible time. Influencing of the air flow in such a manner can also be performed by way of a closed-loop control circuit by way of which the actual state is adapted to a predefined nominal state by continuous controlling action on account of actuating one or a plurality of actuators. Apart from the compensation of variations, signals which lead to a predefined state can also be emitted by the processing installation to the actuators, wherein the predefined state can be a function of the variation of various operating parameters as well as of the temporal profile or another measured variable. The respective open-loop or closed loop-control of the actuators can be performed both electronically as well as mechanically. When the described control of the actuators is performed electronically, an installation for the wireless reception and/or for the wireless forwarding of the measured parameters can also be provided. In this case, there is also the possibility for controlling the actuators of the temperature-control device by wirelessly transmitted signals which are received by the temperature equalization installation by way of the installation for the wireless data transmission. Likewise, the data sent wirelessly by the temperature-control device can be processed by the processing installation, and data based thereon can to send back to the temperature-control device so as to effect specific variations of the actuators. Besides controlling the temperature-control device, the processing installation can also receive data from other devices in the environment of the processing installation, and can actuate the respective devices based on the information received, to the extent that the device to this end has respective actuators. Since it is conceivable that the processing installation can also actuate other devices, information which is not in any direct context with the temperature-control device can also be accessed to this end. For example, the processing installation can resort to additional measured variables such as the ambient temperature, the air humidity, the air pressure, the viscosity of a material, or other data from the environment or from a device in the environment of the processing installation. For controlling the temperature-control device, the data received are processed by the processing device and are subsequently forwarded wirelessly to the temperature-control device. The actuators are actuated according to the information transmitted, on account of which the respective operating parameters of the temperature-control device are influenced with a view to bringing about an ideal operating state of the temperature-control device.

In the case of the temperature-control device also comprising electronic components, an energy supply has to be provided therefor. The energy supply herein can be guaranteed by a battery, for example. However, an external supply is also conceivable, wherein the required energy is directed from an external current source by way of an electric conductor to the temperature-control device. Since the temperature-control device is also used for operating in an explosive atmosphere, for example in a painting booth, an external supply of electric energy is relatively problematic since various guidelines pertaining to explosion prevention have to be met to this end. This type of current supply thus appears to indeed be possible but is to be achieved only by way of comparatively high complexity. Since the temperature-control device on account of the infeeding of compressed air is already supplied with a form of energy, said form of energy can also be used for operating the electrical driven components. To this end, the entrained energy of the mass flow which is directed by way of the hose connection into the temperature-control device has to be converted to electric energy. A turbine which is driven by the mass flow and in turn drives a generator can be used for the conversion to electric energy, for example. A rotary generator, the rotor thereof setting the turbine or a turbine-like installation in rotation is particularly suitable for the generation of a current by means of a generator. The installation described for the conversion of energy can be attached or accommodated, respectively, both in the housing of the temperature-control device as well as outside the housing. An installation of this type can however also be used in other compressed-air-supplied apparatuses. Since the temperature-control device divides the infed mass flow into a hot and a cold air flow, this temperature gradient can likewise be utilized for generating electric energy. To this end, a thermal-electric generator which with the aid of the Seebeck effect converts a temperature gradient to electric energy can be used, for example. However, other methods previously known from the prior art can also be utilized for generating electric energy from the mass flow or the temperature gradient. As has already been explained, a plurality of possibilities for the supply of energy to the temperature-control device are available. When the temperature-control device is supplied with electric energy by way of an electric conductor, by energy conversion of the compressed air, or with the aid of the Seebeck effect, an accumulator which is charged by the energy supply can be provided. This has the advantage that the temperature-control device can be supplied with electric energy even when the external energy supply therefor is insufficient over a short period.

As has already been described, the temperature-control device can also be supplied with electric energy by a battery. Attention herein has to be paid to a battery having to be replaced after a specific operating time. Since the temperature-control device is also to be operated in rooms having an explosive atmosphere, the battery to this end has to meet particular requirements. Alternatively, the housing of the temperature-control device can be designed such that no exchange of substances with the ambient atmosphere takes place. Since the respective protective measures hamper the replacement of the battery, it is expedient for an accumulator which is installed in a fluid-tight manner in the housing to be used. The temperature-control device for charging the accumulator can have externally accessible contacts by way of which the accumulator in the interior of the temperature-control device can be charged. The charging of the accumulator herein can take place outside the explosive atmosphere, on account of which no requirements pertaining to explosion prevention have to be met for the charging of the temperature-control device. In order for the charging of the temperature-control device in a potentially explosive atmosphere to be enabled, contactless charging of the accumulator, in particular by induction, is expedient. This type of energy transmission is meanwhile being used in many fields of technology. Electric toothbrushes and mobile phones have being charged according to this principle for some time already. Since no electric conductor but rather an electromagnetic alternating field is used for the energy transmission in contactless energy transmission, both the housing of the temperature-control device as well as the housing of the energy transmission installation can be sealed in a fluid-tight manner without any particular complexity. Besides, the accumulator does not have to be replaced. A particularly simple possibility of supplying an accumulator within a device with electric energy and of simultaneously achieving a readily implementable explosion prevention for rooms having a potentially explosive atmosphere is thus provided. The energy transmission described offers further advantages in the case of devices which have to be regularly cleaned. This is of particular significance in particular in the sector of paint technology since overspray settles on all surfaces in a painting booth, said overspray having to be removed using solvent-containing cleaning agents. In this context, it is advantageous for the temperature-control device to be protected against the ingress of a respective cleaning agent. This is likewise facilitated by the described form of energy transmission, since the housing can be sealed more easily. The overspray additionally leads to a layer having paint particles precipitating onto the temperature-control device, said layer potentially preventing any energy transmission by way of electric contacts. The contactless energy transmission described for charging an accumulator can also be applied to other products in the field of paint technology, for example for charging accumulators for digital pressure measuring installations.

As is already known from the prior art, the fluid flow in the vortex tube produces a characteristic noise which can be uncomfortable in the close surroundings. At least one silencer can be provided in order for said noise to be reduced, wherein the fluid before exiting the housing 12, 102 passes through the silencer. The silencer is disposed in the housing in such a manner that the fluid that is deflected by the control element 108, 109 to the exhaust air outlet 110, prior to exiting the housing, passes through the silencer. To this end, the silencer can be integrated in the exhaust air chamber, for example. A further possibility lies in disposing the silencer in the fluidic connection between the exhaust air chamber and the exhaust air outlet. In principle, however, many variations pertaining to how the silencer can be disposed so that said silencer is passed through by the outflowing air and thus damping of the noises takes place which by way of the outflowing air are emitted to the environment are conceivable.

According to the prior art in the field of vortex tubes, silencing is performed in most instances by way of various chambers which are sequentially passed through by fluid and which are connected to one another by way of relatively small cross sections. In the case of conventional silencers, the chambers which are passed through by the fluid are relatively large and are often disposed about the vortex tube. Such an arrangement does indeed meet the purpose of the silencer but requires a relatively large amount of space. Therefore, the silencer according to the invention is made from a sintered material which is passed through by the fluid before said fluid exits the housing by way of the exhaust air outlet. The sintered material is composed of individual particles which in the sintering procedure at the contact faces of said particles are connected to one another by heating, thus forming a porous body.

Accordingly, this is an open-porous sintered material which is used for the silencer. On account of said construction, pores which are fluidic connected to one another are created in the sintered material. When a fluid is introduced into said pores, the fluid sequentially passes through the inter-connected pores, on account of which a silencing effect is achieved. Comparative materials are already known from the prior art. Improved silencing by way of a substantially lower investment in space than a conventional silencer can be implemented by the use of a silencer from a sintered material. Additionally, the silencer from sintered material can be made in a substantially more cost-effective manner. Instead of a sintered material, other porous materials having similar properties can also be utilized for the silencer.

Figure 6:
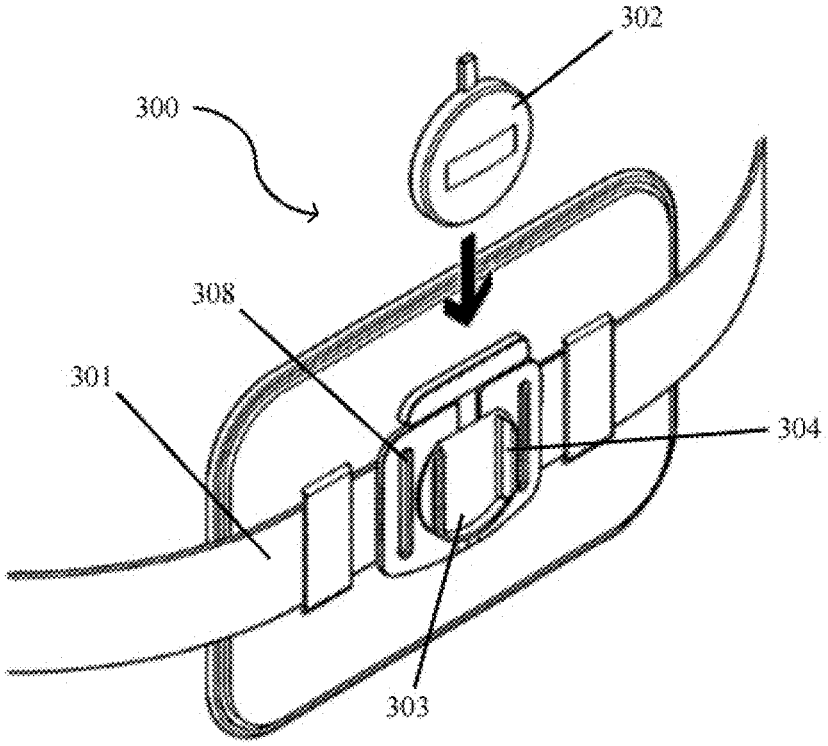
FIG. 6 shows a preferred embodiment of a belt fastening for the temperature-control device according to FIGS. 2 to 4.
Figure 7:
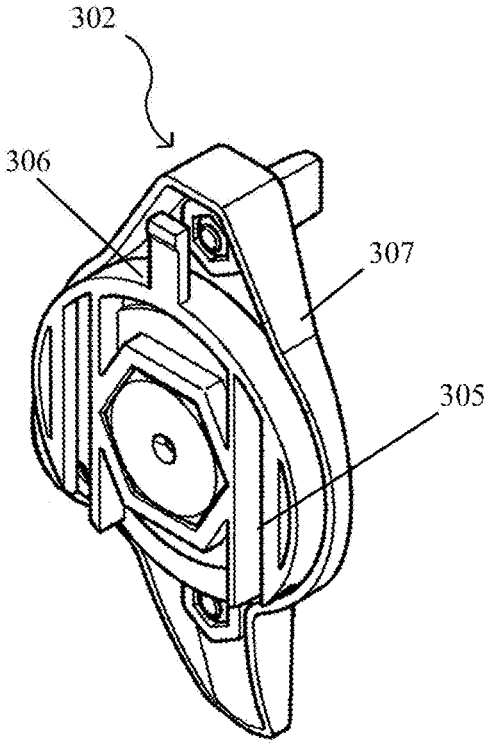
FIG. 7 shows a perspective view of a preferred embodiment of a fastening plate for the belt fastening according to FIG. 6.

Since a temperature-control device according to the invention is to be worn by the wearer on a belt, a fastening possibility has to be provided therefor. A preferred embodiment of a respective fastening can be seen in FIG. 6. It is particularly advantageous for the wearer of the temperature-control device 100 when the device can be rapidly removed from the belt 301 and be rapidly fastened to the belt 301. To this end, a fastening system 300 is provided, wherein the temperature-control device 100 has a fastening plate 302 which can be fastened to a support plate 303, wherein the support plate 303 in the case of a released temperature-control device 100 remains on the belt 301. The fastening of the fastening plate 302 to the support plate 303 is preferably performed by a form-fit. In order for a corresponding form-fit to be achieved, the support plate 303 has a fastening element 304 which can engage in a corresponding fastening receptacle element 305, shown in FIG. 7, of the fastening plate 302, and is designed in such a manner that a form-fit by way of which the temperature-control device 100, connected to the fastening plate 302, is capable of being releasably fastened to the belt 301 is created between the fastening element 304 and the fastening receptacle element 305. Besides the form-fit, another type of connection such as, for example, a force-fit can also be used for the fastening of the fastening plate 302 to the support plate 303. Comparable fastening systems in the most varied design embodiments are already known from the prior art. Of course, a plurality of fastening elements which interact with a plurality of fastening receptacle elements can also be used. Apart from the fastening system 300 described, any other suitable fastening system, for example a dovetail connection, can also be used for the fastening to the belt. Since fastening systems of this type are used in very many sectors, it is possible for a person skilled in the art to select without any further input another fastening system from the prior art for the temperature-control device. As can be seen from FIG. 6 and FIG. 7, a fastening system 300 in which the fastening plate 302 has slot-shaped concavities as fastening receptacle elements 305 into which corresponding elongate convexities of the support plate 303 as fastening element 304 can be push-fitted can be used in the fastening of the temperature-control device 100, wherein the geometry of the elongate fastening elements 304 and of the fastening receptacle elements 305 are designed in such a manner that a form-fit is created between the two elements 304, 305.

In order for a wear experience that is as comfortable as possible to the wearer of the respiratory protection to be enabled it can be provided that the temperature-control device 1 can be rotated relative to the belt 301 about a rotation axis that is perpendicular to the axis of the temperature-control device and to the surface of the belt 301. A fastening device that is rotatable in such a manner is already known in multiple embodiments from the prior art. In order for a fastening of this type to be implemented, the connection between the temperature-control device 100 and the fastening plate 302 can be designed such that both parts are mutually rotatable about a rotation axis that is perpendicular to the axis of the temperature-control device. Since it is also conceivable for improving the wearer comfort that the rotation axis is not exactly perpendicular to the axis of the temperature-control device, the mutual angle of the two axes can also be between 80° and 100°, for example. In the example as per FIG. 7 the fastening plate 302 to this end can be constructed from two parts 306, 307 which can be mutually rotated about a rotation axis. In order for the temperature-control device 100 to be fixed relative to the housing 12, 102 at a specific angle, a locking element on account of which the rotatability between the two parts 306, 307 by way of a friction-fit or form-fit can be restrained in such a manner that a rotation is no longer possible can be provided therefor. In this context, it is possible for specific angles to be defined at which locking of the temperature-control device 100 can be performed. The locking can likewise be possible in each position, for example by way of a fixing installation.

Since the temperature-control device is to be fastened to a belt 301, a belt fastening 308 by way of which the support plate 303 can be fastened directly or indirectly to a belt 301 is provided on the support plate 303. To this end, the support plate 303 has at least one element by way of which the support plate 303 can be fastened to a belt. A fastening of this type can be performed, for example, in that the belt is guided through one or a plurality of slot-shaped openings in the support plate. However, other fastening possibilities to this end can also be chosen. To this end, a multiplicity of fastenings which a person skilled in the art will know how to use for a releasable fastening to the belt are known from the prior art.

It is to be understood that a preferred exemplary embodiment of the invention has been described only in an exemplary manner by means of the figures. Other constructions, materials, or connection types which meet the requirements according to the invention are conceivable and will be derived by a person skilled in the art when perusing the explanations above and the prior art.

The invention claimed is:

1. A temperature-control device for heating and/or cooling gases or gas mixtures, the device comprising:

at least one air inlet;

at least one air outlet; and at least one vortex tube, each of the at least one vortex tube having a vortex tube inlet, a hot air exit, and a cold air exit, wherein the at least one air inlet is fluidically connectable to at least one vortex tube inlet of the at least one vortex tube, wherein the at least one air outlet is fluidically connectable to either at least one hot air exit or at least one cold air exit of the at least one vortex tube in at least one flow direction, the at least one hot air exit and the at least one cold air exit not being capable of being simultaneously fluidically connected to the at least one air outlet, and wherein at least one control element is provided by means of which either the amount of air flow between the at least one hot air exit and the at least one air outlet, or the amount of air flow between the at least one cold air exit and the at least one air outlet is adjustable.

2. The temperature-control device of claim 1, wherein ends of the at least one vortex tube are each provided with a shut-off valve.

3. The temperature-control device of claim 2, wherein the at least one vortex tube comprises first and second vortex tubes, and wherein the second vortex tube is completely closed by at least one of the shut-off valves when fluid passes through the first vortex tube.

4. The temperature-control device of claim 3, wherein the first vortex tube is completely closed by at least one of the shut-off valves when fluid passes through the second vortex tube.

5. The temperature-control device of claim 2, wherein at least one of the shut-off valves is a non-return valve.

6. The temperature-control device of claim 1, wherein an exhaust air chamber is provided, and wherein either the at least one cold air exit or the at least one hot air exit of the at least one vortex tube is fluidically connectable to the exhaust air chamber.

7. The temperature-control device of claim 6, wherein the exhaust air chamber is fluidically connected to at least one exhaust air outlet, and wherein the one of the at least one hot air exit and the at least one cold air exit of the at least one vortex tube that is not fluidically connected to the at least one air outlet is fluidically connected to ambient air by way of the at least one exhaust air outlet.

8. The temperature-control device of claim 6, wherein at least one actuator element is provided by way of which the cross section of the connection between the exhaust air chamber and ambient air is at least reducible at at least one location.

9. The temperature-control device of claim 1, wherein the at least one vortex tube comprises a first vortex tube, and wherein the at least one air outlet is fluidically connectable to either the hot air exit of the first vortex tube or the cold air exit of the first vortex tube, the hot air exit of the first vortex tube and the cold air exit of the first vortex tube not being capable of being simultaneously fluidically connected to the at least one air outlet.

10. The temperature-control device of claim 1, wherein the at least one vortex tube is disposed in a housing, wherein an exhaust air chamber with at least one silencer is integrated into the housing, and wherein fluid, prior to exiting the housing, passes through the at least one silencer.

11. The temperature-control device of claim 10, wherein the at least one silencer is made from a sintered material that is passed through by the fluid before the fluid exits the housing through an exhaust air outlet, which is fluidically connected to the exhaust air chamber.

12. The temperature-control device of claim 1, wherein the temperature-control device has a fastening plate for fastening to a support plate, and wherein the support plate has at least one element by way of which the support plate is fastenable directly or indirectly to a belt.

13. The temperature-control device of claim 1, wherein the at least one vortex tube is composed of at least two individual parts which are connected to one another by way of at least one plug connection.

14. The temperature-control device of claim 1, wherein the at least one vortex tube comprises a first vortex tube, and wherein a return line chamber, through which fluid upon exiting the cold air exit of the first vortex tube is guided directly or indirectly to the at least one air outlet when the fluidic connection between the hot air exit of the first vortex tube and the at least one air outlet is closed by the at least one control element, is provided.

15. The temperature-control device of claim 1, wherein either the direction of exiting fluid flow at the at least one hot air exit, or the direction of exiting fluid flow at the at least one cold air exit, is redirected by 160° to 200° to the opposite direction.

16. The temperature-control device of claim 1, wherein a measuring installation which serves for measuring at least one of a pressure, a temperature, air humidity, volumetric flow, mass flow, or density within a housing of the temperature-control device is provided.

17. The temperature-control device of claim 16, wherein measurements made by the measuring installation serve for controlling an air flow fed at the at least one air inlet.

18. The temperature-control device of claim 17, wherein measurements made by the measuring installation serve for controlling directly or indirectly an actuator element controlling the at least one cold air exit and/or the at least one hot air exit.

19. A system for supplying respiratory air, the system comprising:

a force-ventilated respiratory protection mask; and the temperature-control device of claim 1.

20. A temperature-control device for heating and/or cooling gases or gas mixtures, the device comprising:

at least one air inlet;

at least one air outlet; and first and second vortex tubes, each of the vortex tubes having a vortex tube inlet, a hot air exit, and a cold air exit, wherein the at least one air inlet and the at least one air outlet are fluidically connectable by way of the first and second vortex tubes, and the first and second vortex tubes are disposed in a common housing, wherein the at least one air inlet is fluidically connectable to either the vortex tube inlet of the first vortex tube or the vortex tube inlet of the second vortex tube, the at least one air inlet not being capable of being simultaneously fluidically connected to the vortex tube inlet of the first vortex tube and the vortex tube inlet of the second vortex tube, wherein the at least one air outlet is fluidically connectable to either the hot air exit of the second vortex tube or the cold air exit of the first vortex tube, the at least one air outlet not being capable of being simultaneously fluidically connected to the hot air exit of the second vortex tube and the cold air exit of the first vortex tube, and wherein at least one control element is provided by means of which either the amount of air flow between the hot air exit of the second vortex tube and the at least one air outlet, or the amount of air flow between the cold air exit of the first vortex tube and the at least one air outlet is adjustable.

21. A temperature-control device for heating and/or cooling gases or gas mixtures, the device comprising:

at least one air inlet;

at least one air outlet; and at least one vortex tube, each of the at least one vortex tube having a vortex tube inlet, a hot air exit, and a cold air exit, wherein the at least one air inlet is fluidically connectable to at least one vortex tube inlet of the at least one vortex tube, and the at least one air outlet is fluidically connectable to at least one hot air exit and at least one cold air exit of the at least one vortex tube in at least one flow direction, wherein at least one control element is provided by means of which the amount of air flow between the at least one hot air exit and the at least one air outlet, or the amount of air flow between the at least one cold air exit and the at least one air outlet is adjustable, and wherein each of the at least one vortex tube is configured so as to be straight without any bends over its entire length.

* * * * *